US008573431B2

(12) United States Patent
Shepard et al.

(10) Patent No.: US 8,573,431 B2
(45) **Date of Patent: *Nov. 5, 2013**

(54) BEVERAGE CONTAINER CLOSURE WITH VENTING

(75) Inventors: Seth Shepard, Port Orchard, WA (US); Joseph Daniel Tomascheski, Woodinville, WA (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/226,669

(22) Filed: Sep. 7, 2011

(65) Prior Publication Data

US 2013/0056467 A1 Mar. 7, 2013

(51) Int. Cl.
*B65D 51/18* (2006.01)

(52) U.S. Cl.
USPC ..... 220/254.9; 220/714; 220/715; 220/262; 220/254.8; 220/254.1; 220/259.3; 220/259.4; 220/259.5; 220/256.1; 215/359; 215/315

(58) Field of Classification Search
USPC ..... 220/254.4, 820, 821, 714, 715, 373, 220/254.5; 215/315, 320
See application file for complete search history.

(56) References Cited

U.S. PATENT DOCUMENTS

| | | | |
|---|---|---|---|
| 118,860 | A | 9/1871 | Kent |
| 404,192 | A | 5/1889 | Haas |
| 421,282 | A | 2/1890 | Jackson |
| 599,389 | A | 2/1898 | Jackson |
| 656,000 | A | 8/1900 | Wall |
| 657,636 | A | 9/1900 | Bingham |
| 768,355 | A | 8/1904 | Bolen |
| 2,210,206 | A | 8/1940 | Fisher |
| 2,274,849 | A | 3/1942 | Peterson |
| 2,447,870 | A | 8/1948 | Polcyn |
| 2,884,157 | A | 4/1959 | Lampkin |

(Continued)

FOREIGN PATENT DOCUMENTS

| | | |
|---|---|---|
| DE | 3402894 | 8/1985 |
| DE | 20003371 | 4/2000 |
| DE | 20 2011 002273 | 4/2011 |
| WO | 0034143 | 6/2000 |

OTHER PUBLICATIONS

European search report for Application No. EP12173632 dated Oct. 18, 2012.

*Primary Examiner* — Mickey Yu
*Assistant Examiner* — Allan Stevens
(74) *Attorney, Agent, or Firm* — Davis Wright Tremaine LLP; George C. Rondeau, Jr.

(57) ABSTRACT

A beverage container closure that is adapted for closing an open end of a beverage container. The lid is selectively couplable to the beverage container and includes a selectively openable stopper that when closed, creates a fluid-tight seal between the beverage container and the environment. The stopper may be selectively opened by a user pressing a button disposed on a side of the beverage container closure. The stopper is subsequently automatically closed when the user releases the button. Thus, the user may open and close the beverage container closure using a single hand without the need to remove the beverage container closure from the beverage container. The beverage container closure includes a venting mechanism configured to vent the beverage container before the stopper is opened when the user depresses the button, thereby allowing pressure in the beverage container to equalize before the stopper is opened.

19 Claims, 16 Drawing Sheets

(56) References Cited

U.S. PATENT DOCUMENTS

| | | | | | |
|---|---|---|---|---|---|
| 3,059,816 | A | | 10/1962 | Goldstein | |
| 3,739,938 | A | | 6/1973 | Paz | |
| 3,964,631 | A | | 6/1976 | Albert | |
| 3,967,748 | A | * | 7/1976 | Albert | 220/715 |
| 3,972,443 | A | * | 8/1976 | Albert | 220/715 |
| 4,094,433 | A | | 6/1978 | Numbers | |
| 4,099,642 | A | | 7/1978 | Nergard | |
| 4,136,799 | A | | 1/1979 | Albert | |
| 4,212,408 | A | | 7/1980 | Valenzona | |
| 4,276,992 | A | | 7/1981 | Susich | |
| 4,303,173 | A | | 12/1981 | Nergard | |
| 4,676,411 | A | | 6/1987 | Simasaki | |
| 4,834,270 | A | | 5/1989 | Messner | |
| 5,427,271 | A | | 6/1995 | Wang | |
| 5,485,938 | A | | 1/1996 | Boersma | |
| 5,495,966 | A | | 3/1996 | Won | |
| 5,615,808 | A | | 4/1997 | Huang | |
| 5,918,854 | A | | 7/1999 | Barrash et al. | |
| 5,944,235 | A | | 8/1999 | Won | |
| 6,098,834 | A | | 8/2000 | Hatsumoto et al. | |
| 6,116,476 | A | * | 9/2000 | Huang | 222/506 |
| 6,626,314 | B1 | | 9/2003 | McHenry et al. | |
| 6,763,964 | B1 | | 7/2004 | Hurlbut et al. | |
| 7,413,096 | B2 | | 8/2008 | Morgan et al. | |
| 7,546,933 | B2 | | 6/2009 | Pinelli | |
| 7,997,442 | B2 | | 8/2011 | Pinelli | |
| 8,297,462 | B1 | | 10/2012 | Joyce | |
| 8,376,162 | B2 | | 2/2013 | Yang | |
| 2002/0033400 | A1 | | 3/2002 | Rohrer et al. | |
| 2004/0040962 | A1 | | 3/2004 | Bielecki et al. | |
| 2004/0217139 | A1 | | 11/2004 | Roth et al. | |
| 2005/0029265 | A1 | | 2/2005 | Morgan et al. | |
| 2006/0096983 | A1 | | 5/2006 | Patterson | |
| 2006/0175331 | A1 | | 8/2006 | Lin et al. | |
| 2006/0226160 | A1 | | 10/2006 | Elsaden et al. | |
| 2007/0210093 | A1 | | 9/2007 | Pinelli | |
| 2008/0156817 | A1 | | 7/2008 | Roseblade et al. | |
| 2008/0237233 | A1 | | 10/2008 | Choi et al. | |
| 2008/0272134 | A1 | | 11/2008 | Rohe | |
| 2011/0132908 | A1 | | 6/2011 | Meehan | |
| 2011/0309095 | A1 | | 12/2011 | Pinelli | |

* cited by examiner

BEVERAGE CONTAINER CLOSURE WITH VENTING

BACKGROUND OF THE INVENTION

1. Field of the Invention

The present invention is directed generally to lids for liquid storage vessels such as for beverage or food containers and more particularly to lids with movable components that include pressure venting features.

2. Description of the Related Art

Prior art lids are typically of one of three types. The first type is a solid unitary lid that does not include openings or apertures through which the contents of a liquid storage vessel may exit the vessel. To drink from the vessel, a user must remove the lid. The second type, which may also be of a unitary construction, includes one or more unobstructed apertures through which the liquid may exit the vessel. In the second type, the apertures are always open. If the vessel is inadvertently tipped or dropped, the contents of the vessel may spill. The third type of lid includes one or more apertures through which the liquid may exit the vessel and a means for selectively opening and closing the apertures. When using the third type of lid, the user may selectively open the apertures to remove the contents from the vessel and selectively close the apertures to maintain the contents inside the vessel. Further, by closing the apertures, the lid may help insulate the contents from the environment outside the vessel.

DETAILED DESCRIPTION OF THE INVENTION

Overview

The present invention is directed to systems and methods for providing pressure venting for a beverage container closure or lid. When a hot liquid such as coffee is stored in a closed beverage container, the pressure inside the beverage container builds. Due to this pressure, for some beverage containers there is a potential for liquid or gas to be expelled or spray from an opening in the beverage container when it is opened by a user (e.g., for drinking from the beverage container). Embodiments of the invention disclosed herein are directed to venting mechanisms for beverage container closures that prevent the spray of liquid or gas from a drink hole or vent hole of beverage container closures when the beverage container closures are opened by a user (e.g., to drink a beverage therefrom). Initially, with reference to FIGS. 1-12, a beverage container closure or lid that includes an exemplary venting mechanism is described generally. Afterward, with reference to FIGS. 13A, 13B, 13C, and 13D, the venting mechanism of the beverage container closure is described in detail.

Beverage Container Closure

Figure 1:
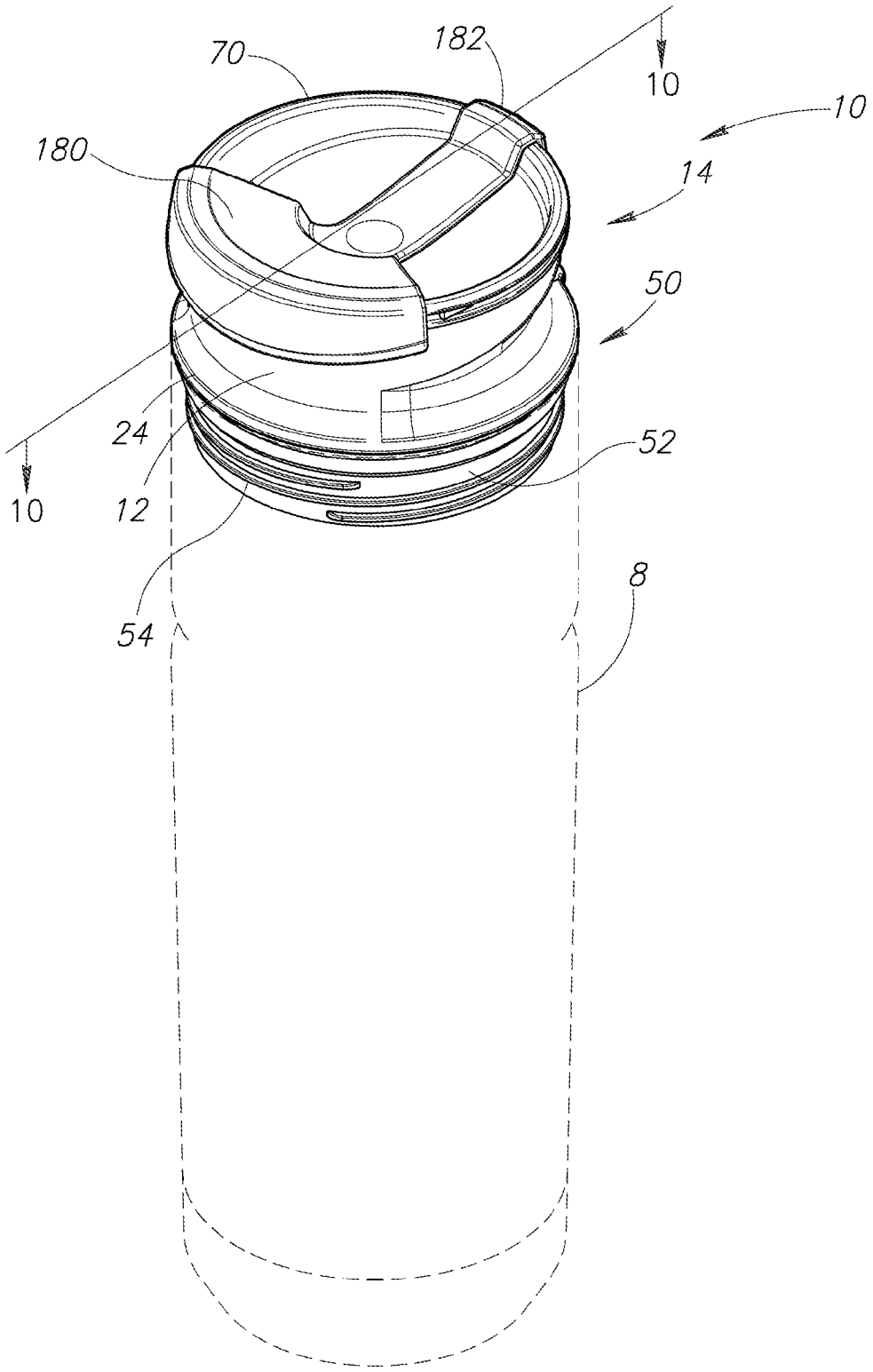
FIG. 1 is a top left side perspective view of a beverage container closure constructed in accordance with the present invention.
Figure 2:
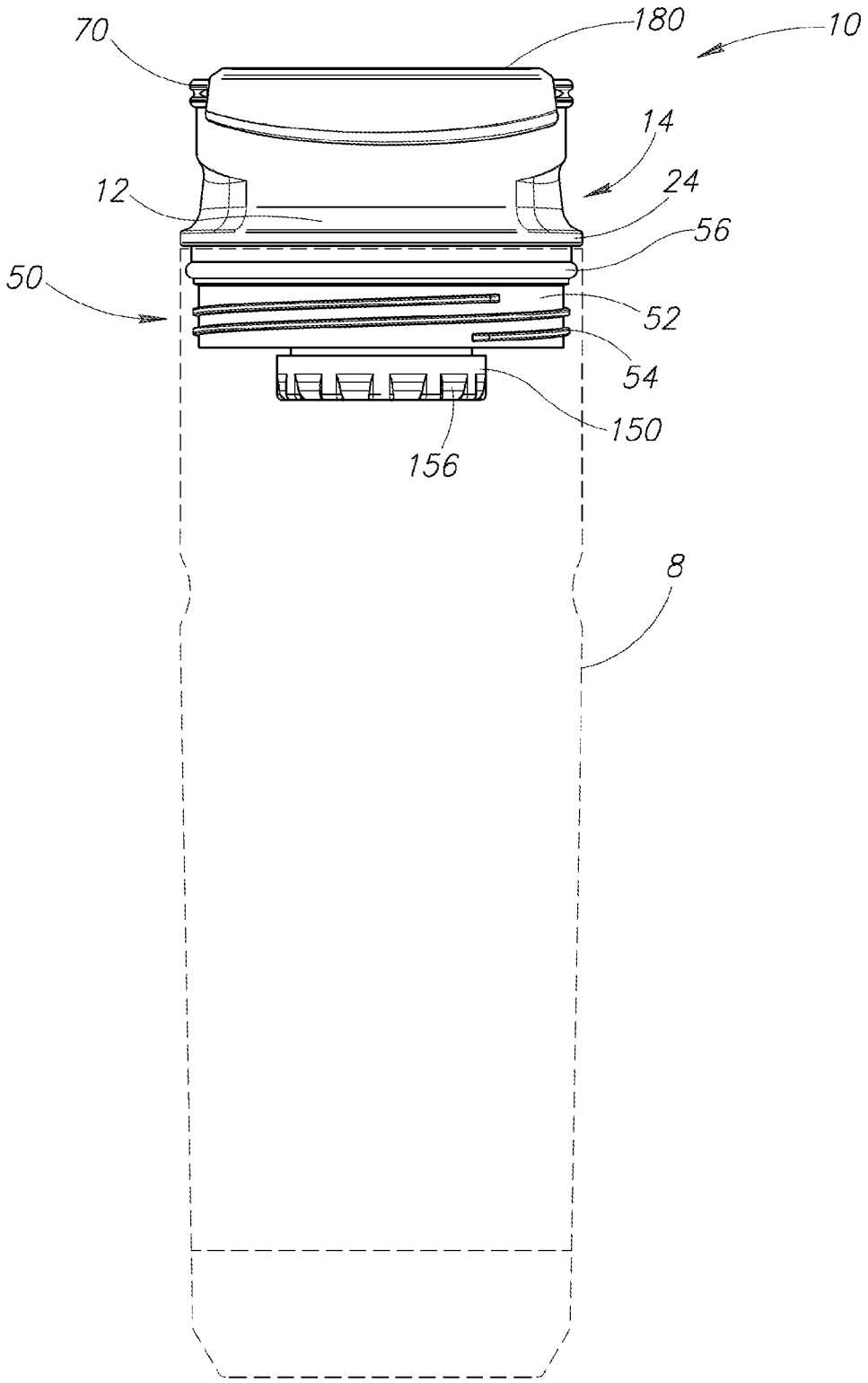
FIG. 2 is a front elevational view of the beverage container closure of FIG. 1.
Figure 3:
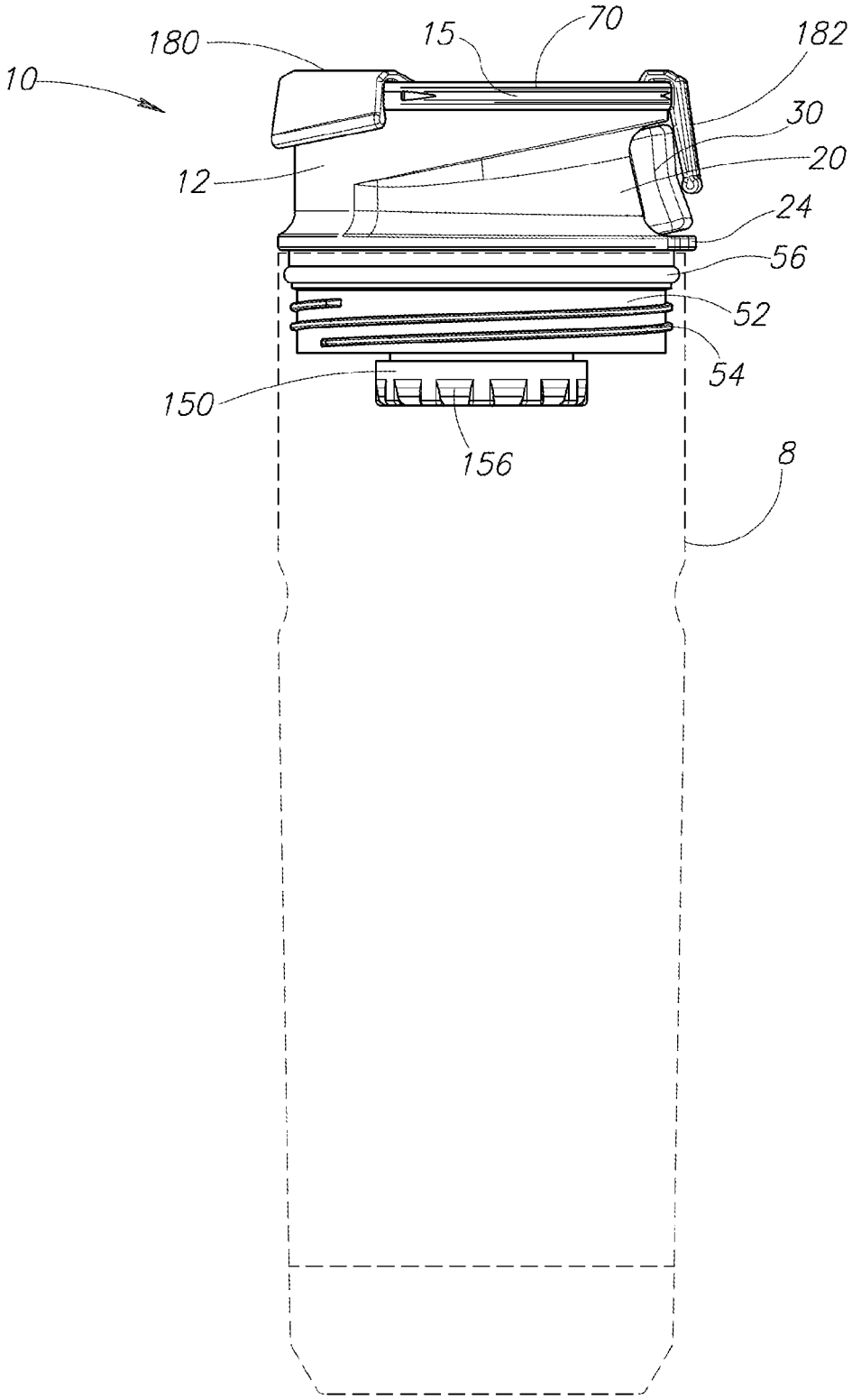
FIG. 3 is a left side elevational view of the beverage container closure of FIG. 1.
Figure 4:
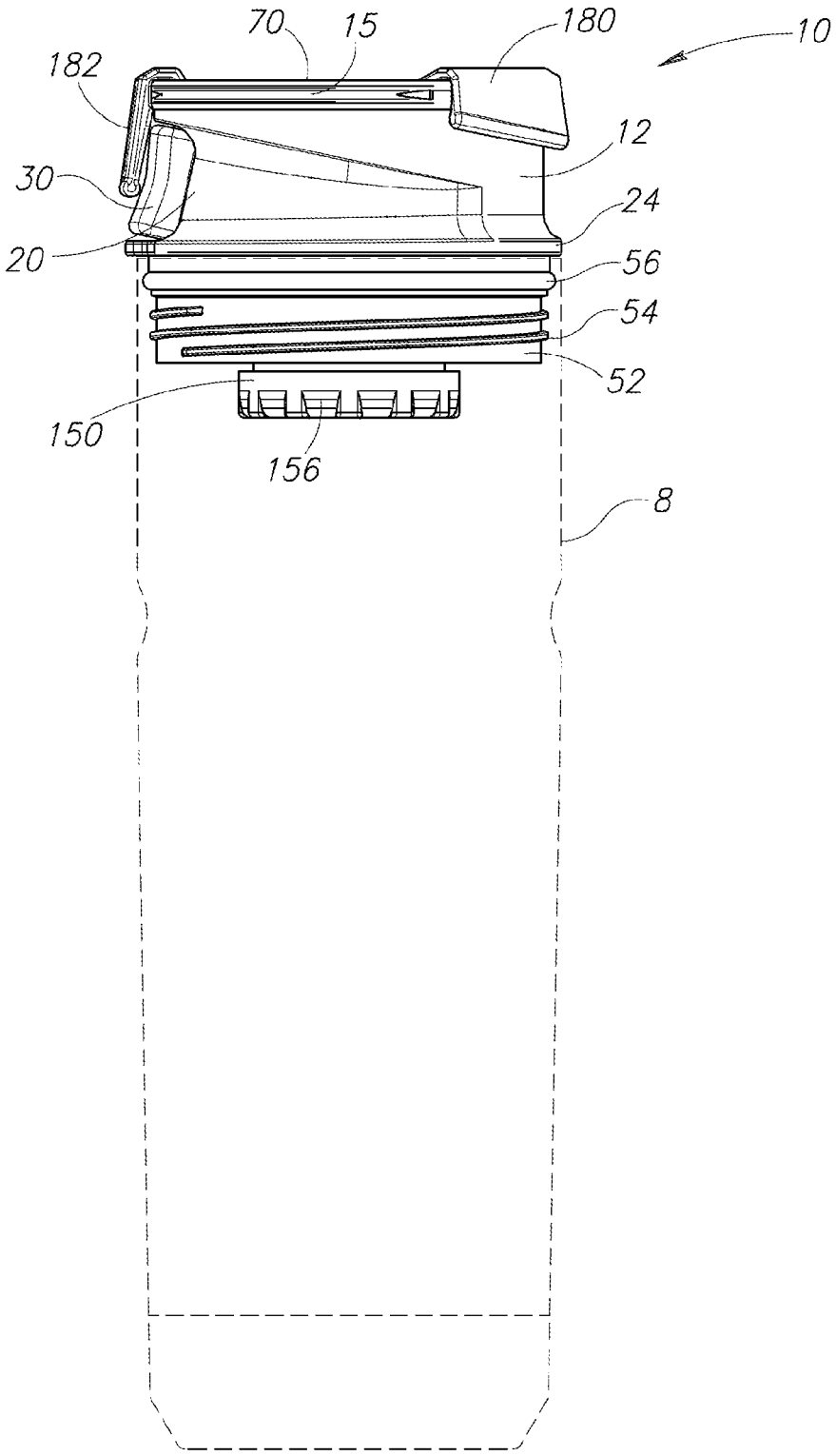
FIG. 4 is a right side elevational view of the beverage container closure of FIG. 1.
Figure 5:
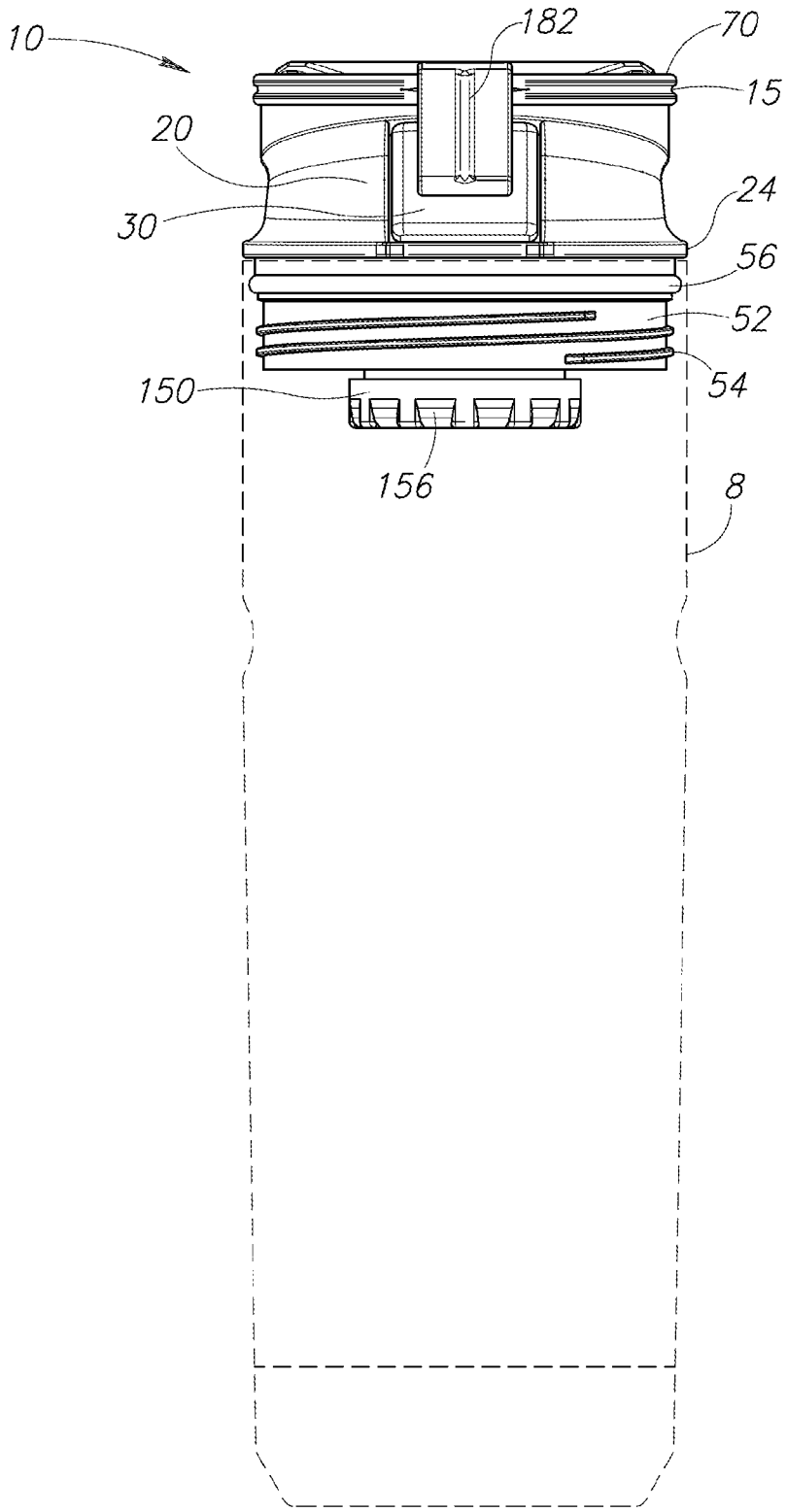
FIG. 5 is a rear elevational view of the beverage container closure of FIG. 1.
Figure 6:
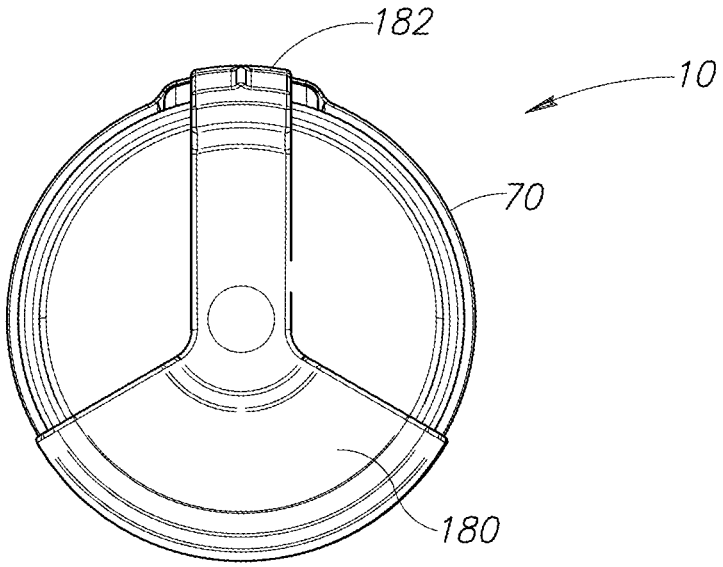
FIG. 6 is a top plan view of the beverage container closure of FIG. 1.
Figure 7:
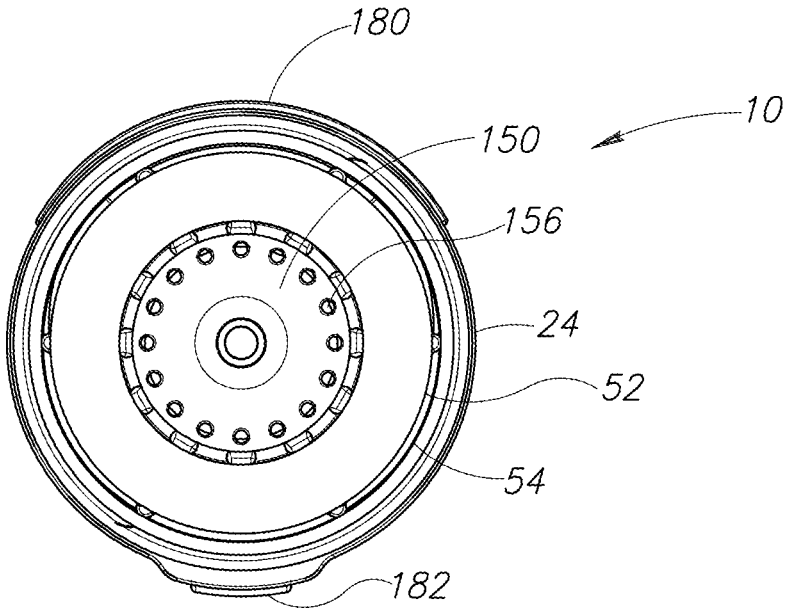
FIG. 7 is a bottom plan view of the beverage container closure of FIG. 1.

A beverage container closure or lid, in accordance with an embodiment of the present invention, is generally indicated by reference numeral 10 in FIG. 1. The lid 10 has a generally cylindrical main body 12 that is adapted for closing an open end of a conventional drinking vessel or beverage container 8 (shown in dashed lines). The beverage container 8 may be any suitable type of container such as the tumbler type (that is, without a handle) for use in automotive beverage receptacles, or for transport in backpacks, book bags, and the like. The lid 10 is selectively couplable to the beverage container 8 by any suitable means such as threads 54 disposed on an outer surface of a sidewall 52 of a lower, downwardly depending portion 50 of the main body 12. The lid 10 also includes a flexible o-ring seal member 56 (see FIG. 2) positioned adjacent the sidewall 52 of the lower portion 50 at a location near a bottom surface of an upper portion 14 of the main body 12. The particular configuration for mating the lid 10 to the container 8 is a matter of choice for one of ordinary skill in the art. Thus, although threads 54 and the seal member 56 have been shown in this embodiment, those of ordinary skill in the art will appreciate that any other means for attaching and sealing the lid 10 with respect to the beverage container 8 may be substituted.

Figure 8:
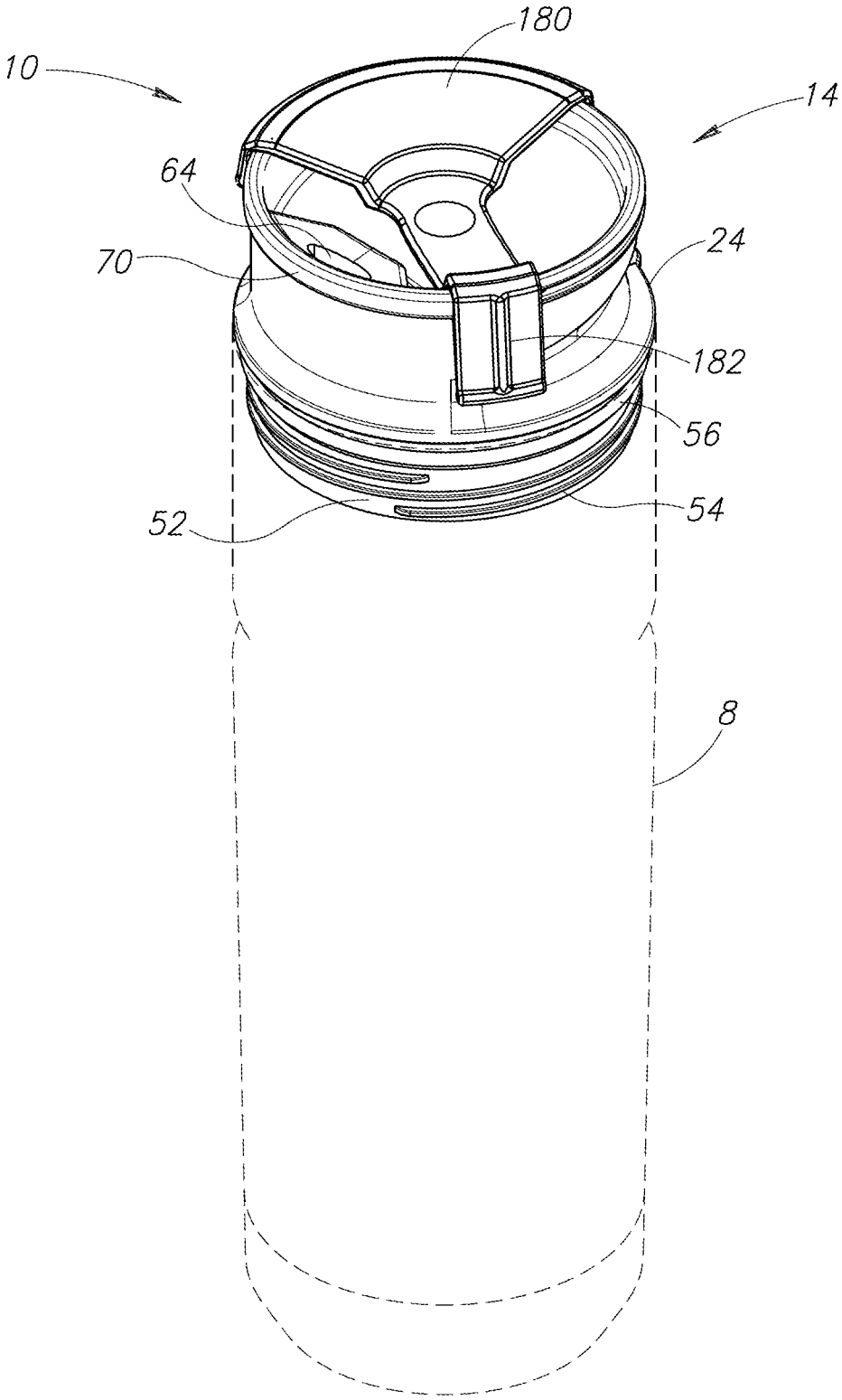
FIG. 8 is a top left side perspective view of the beverage container closure of FIG. 1, with a dust cover rotated away from the drinking opening in the beverage container closure to provide a user with access to the drinking opening.
Figure 9:
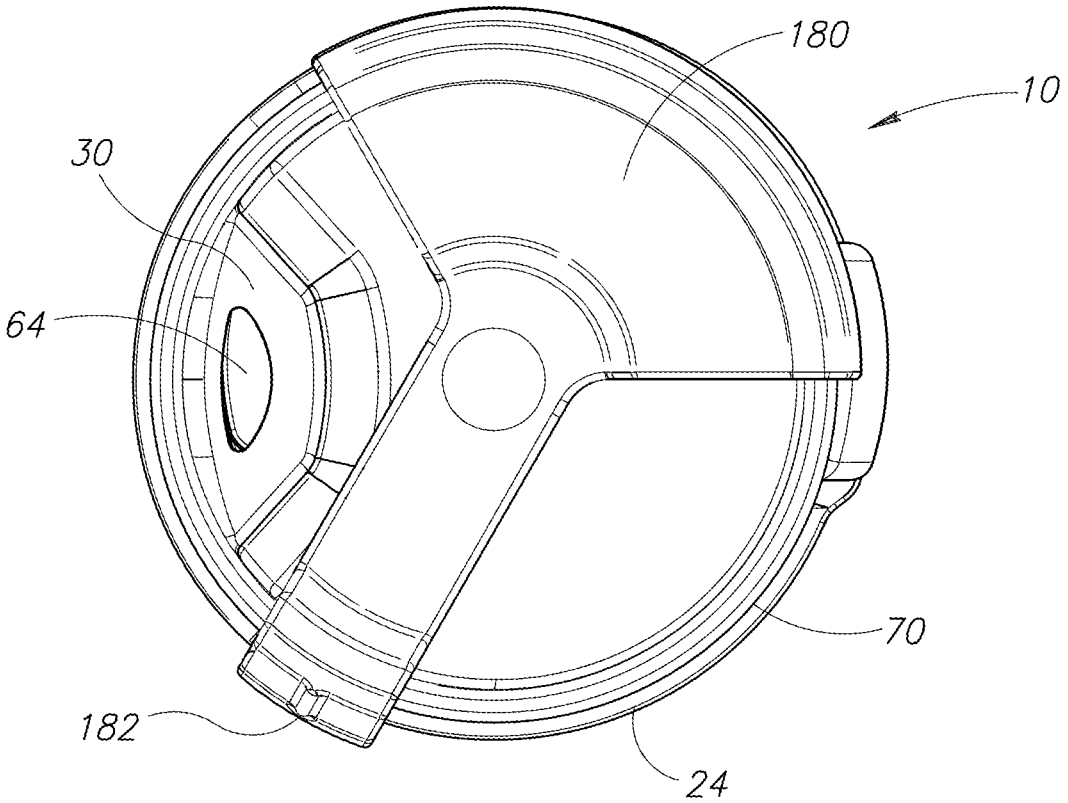
FIG. 9 is an enlarged top plan view of the beverage container closure of FIG. 8, with the dust cover rotated away from the drinking opening in the beverage container.

As best seen in FIG. 8, the upper portion 14 of the main body 12 also includes a top rim portion 70 configured for contact with a user's lips when the entire assembly is tipped toward the user, such that the user may drink from the beverage container 8 to which the lid 10 is attached. The upper portion 14 also includes an aperture or drinking opening 64 configured to permit fluid passage therethrough when a user drinks a beverage. Although not in the illustrated embodiment, in some embodiments the upper portion further includes an air vent opening over a seal seat portion 65 (see FIG. 10) of the upper portion 14 of the main body 12 that allows liquid to flow more freely out of the beverage container 8 when a user drinks therefrom.

Figure 12:
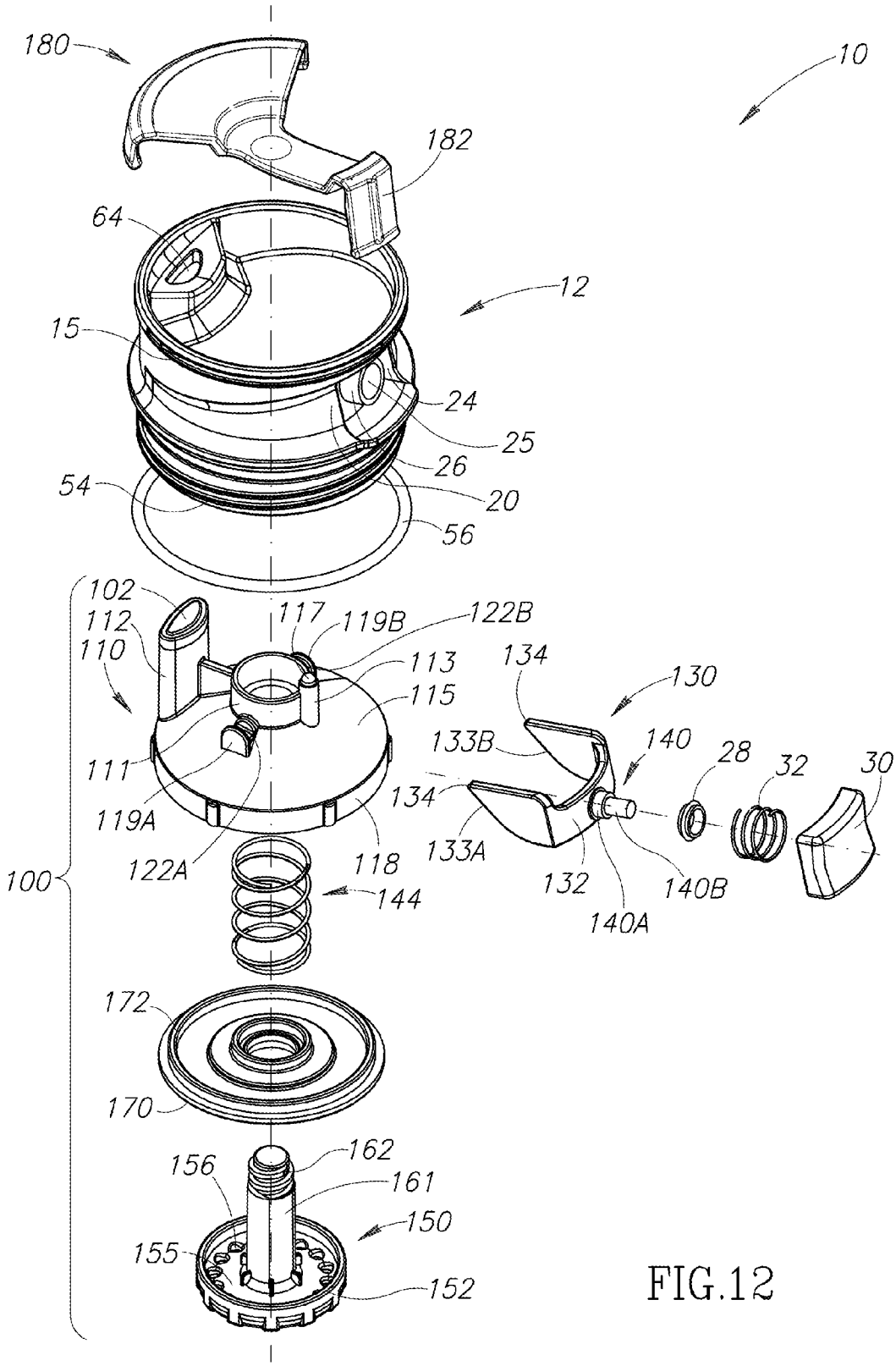
FIG. 12 is an enlarged, exploded perspective view of a stopper assembly of the beverage container closure of FIG. 1.

Fluid communication between the upper portion 14 and the interior of the beverage container 8 is controlled by way of a selectively openable stopper assembly 100, which may best be viewed in FIG. 12. The stopper assembly 100 includes a stopper 110 having a first raised portion 112 configured for attachment of a stopper seal 102 thereto (e.g., by a press fit). The stopper seal 102 may be formed from a flexible material and is shaped to be positioned over a top surface 114 (see FIG. 10) of the first raised portion 112. The stopper 110 also includes a second raised portion 113 configured for attachment of a vent hole seal 117 thereto (e.g., by a press fit). Below the raised portions 112 and 113 of the stopper 110 is an angled base or body portion 115. Further, extending in a downward direction from the body portion 115 of the stopper 110 is a circumferential sidewall 118. The sidewall 118 is configured to engage a stopper cap 170.

The stopper 110 also comprises an upwardly extending cylindrical wall 111 (see FIGS. 10 and 12) sized to be slightly larger than a downwardly extending cylindrical wall 13 of the upper portion 14 of the main body 12, such that the walls 13 and 111 may move axially freely in telescoping fashion with respect to each other when the lid 10 is operated by a user as described below. The stopper 110 also includes a pair of spaced apart cam followers 119A and 119B having respective cam follower surfaces 122A and 122B (see FIGS. 12, 13B, 13C, and 13D) disposed on the base portion 115 of the stopper on opposing sides of the upwardly extending cylindrical wall 111. The functionality of the cam followers 119A and 119B are described herein below.

Figure 10:
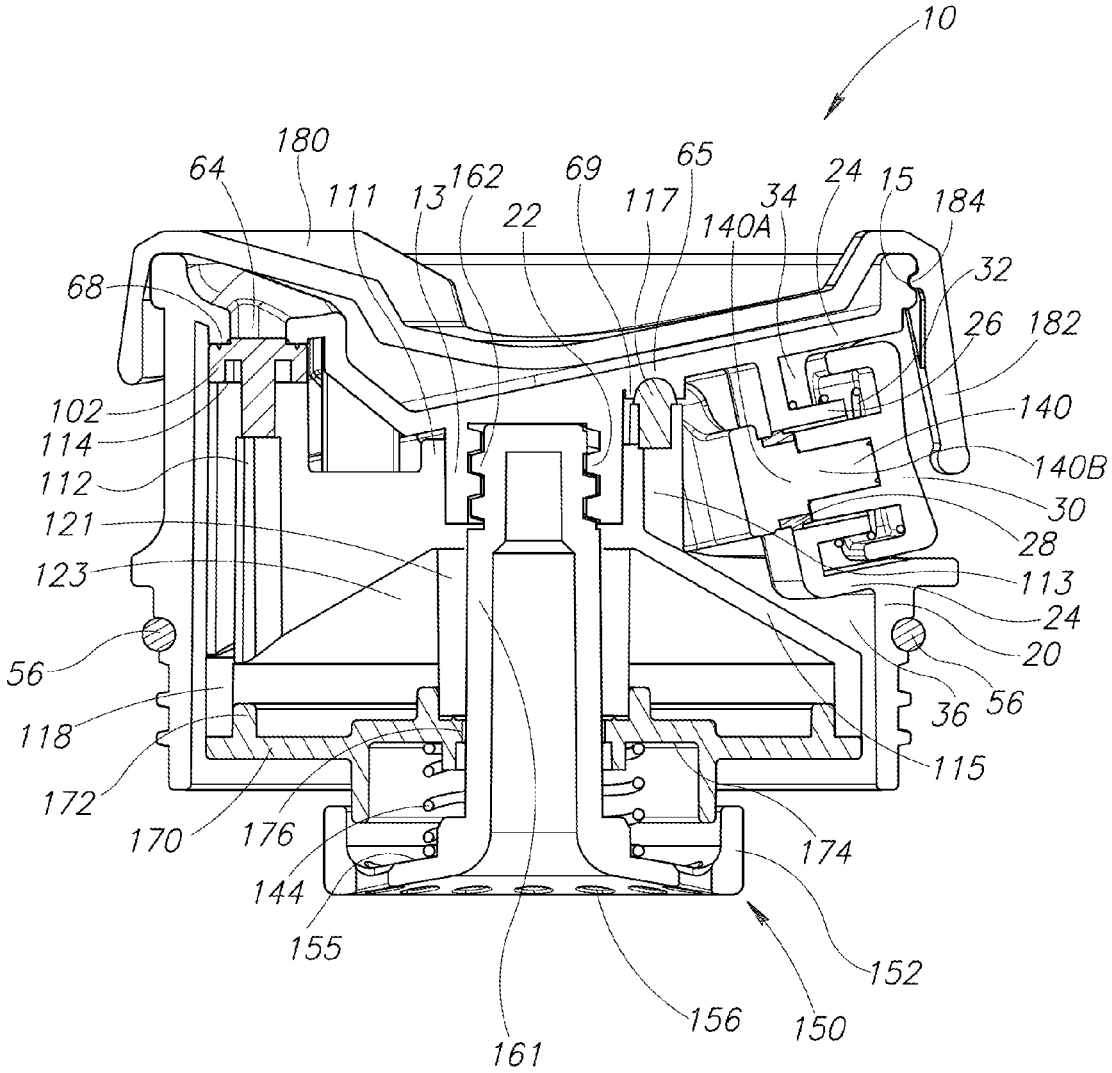
FIG. 10 is an enlarged cross-sectional left side elevational view of the beverage container closure of FIG. 1 taken substantially along the line 10-10 of FIG. 1.

As may best be viewed in FIG. 10, the stopper cap 170 includes a raised portion 172 configured to fit within the circumferential sidewall 118 of the stopper 110. The stopper cap 170 further includes an opening defined by an annular-shaped edge 176, and a bottom surface 174. These features are described below. When the stopper cap 170 is coupled to the stopper 110, an interior hollow region 123 is formed. To provide insulation between the interior of the beverage container 8 and the environment, an insulating substance, such as a ring of styrene, may be placed within the interior hollow region 123 of the stopper 110.

The stopper assembly 100 also includes a stopper cover 150 (see FIG. 10) configured for retaining the stopper assembly within a hollow interior region 36 of the main body 12. The stopper cover 150 includes a base portion 152 including a plurality of spaced apart apertures or openings 156 disposed therein to allow for fluid passage therethrough. Further, the stopper cover 150 comprises an upwardly extending substantially cylindrically-shaped rod 161 terminating with an engagement portion 162 with external threads. As shown, the rod 161 passes through the opening defined by the annular-shaped edge 176 in the stopper cap 170, and through a downwardly extending cylindrical wall 121 of the stopper 110, where it is threadably engaged with a stopper cover engagement portion 22 (with internal threads) of the downwardly extending cylindrical wall 13 of the upper portion 14 of the main body 12, thereby securing the stopper cover 150 (and the other components of the stopper assembly 100) to the main body 12 of the lid 10.

As may best be viewed in FIG. 10, the stopper assembly 100 further includes a stopper biasing member 144 (in the illustrated embodiment, a spring) configured for biasing the stopper 110 upward into the closed position which provides a fluid-tight seal for the lid 10. The stopper biasing member 144 is sized to have a diameter that is slightly larger than the upwardly extending substantially cylindrically-shaped rod 161 of the stopper cover 150, such that the stopper biasing member may be positioned over the rod 161 and between a top surface 155 of the base portion 152 of the stopper cover 150 and an inner bottom surface 174 of the stopper cap 170 (see FIG. 10).

Figure 11A:
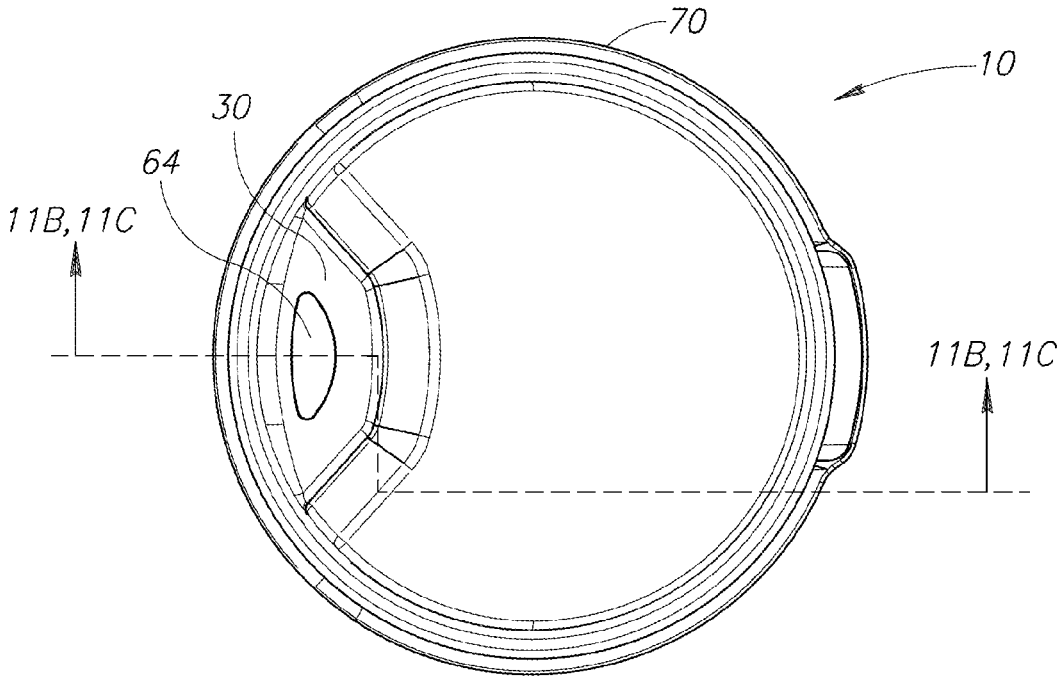
FIG. 11A is an enlarged top plan view of the beverage container closure of FIG. 1 with the dust cover removed.
Figure 11B:
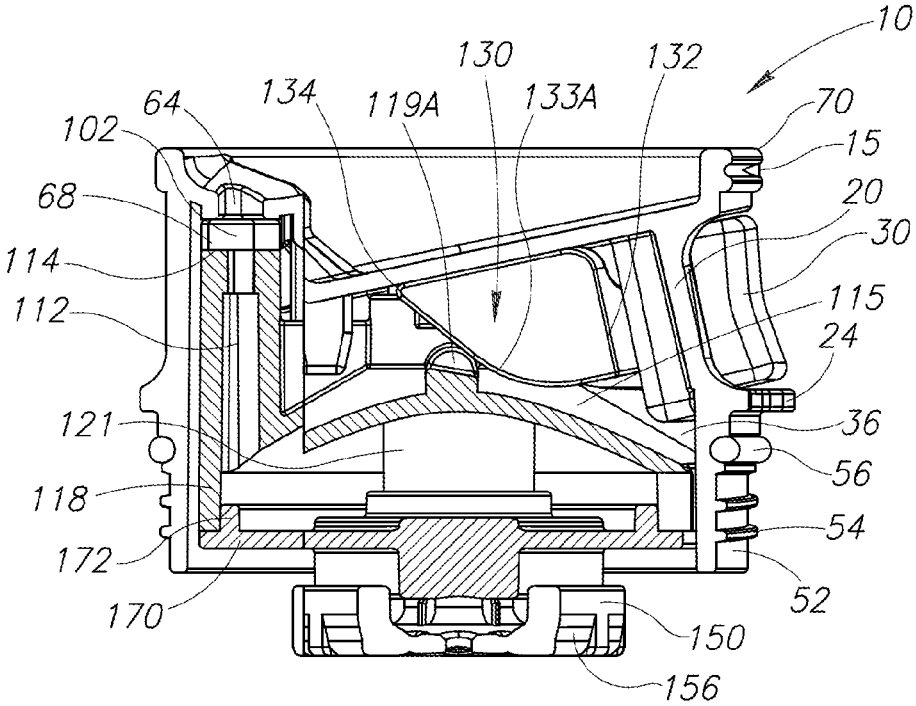
FIG. 11B is a sectional view taken substantially along the line 11B,11C-11B,11C of FIG. 11A with the stopper in the closed position.
Figure 11C:
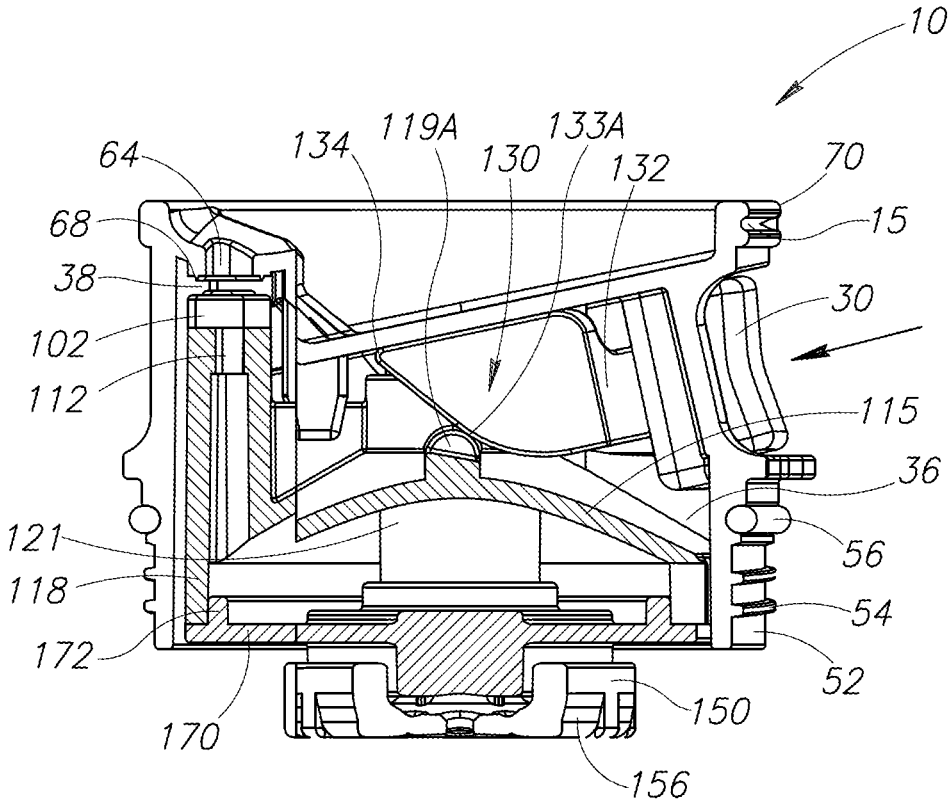
FIG. 11C is a sectional view taken substantially along the line 11B,11C-11B,11C of FIG. 11A with the stopper in the opened position.

As may best be viewed in FIGS. 11B, 11C, and 12, the stopper assembly 100 further includes an actuating member 130 configured for acting on the cam followers 119A and 119B of the stopper 110 to selectively move the stopper between the opened position and the closed position. The actuating member 130 includes first and second cam surfaces 133A and 133B (or "stopper engagement portions") spaced apart from each other and configured for slidable engagement with the first and second cam followers 119A and 119B (or "actuating member engagement portions"), respectively, of the stopper 110. The cam surfaces 133A and 133B are each ramp-shaped and are angled downward from a distal end 134 toward a proximal end 132 of the actuating member 130 (see FIGS. 11B and 11C). As described below, the cam surfaces 133A and 133B engage the surfaces of the cam followers 119A and 119B, respectively, to move the stopper 110 between the upward closed and lowered opened positions (shown in FIGS. 11B and 11C, respectively). The actuating member 130 further includes a rod 140 (see FIG. 12) disposed at the proximal end 132 having a base portion 140A and a button coupling portion 140B. The button coupling portion 140B of the rod 140 is sized and shaped to be inserted (e.g., press fit) into a recessed portion of a button 30 (see FIGS. 10 and 13) configured to permit a user to actuate the actuating member 130 by simply pressing the button inward. Further, as discussed in detail below, a venting wiper seal member 28 (see FIGS. 10, 12, and 13B-D) is disposed around the base portion 140A of the rod 140.

The operation of the stopper assembly 100 is now described with reference to FIGS. 11B and 11C, which show cut-away left side elevational views of the lid 10 when the stopper 110 is in the sealed or closed position (FIG. 11B) and the opened position (FIG. 11C). As can be seen, the stopper assembly 100 is positioned within the hollow interior region 36 of the main body 12. The engagement portion 162 of the stopper cover 150 is engaged with the stopper cover engagement portion 22 of the downwardly extending cylindrical wall 13 of the upper portion 14 disposed in the hollow interior region 36 of the main body 12. For example, the stopper cover 150 may be threadably engaged with the main body 12 to retain the stopper cover and the other components of the stopper assembly 100.

As shown in FIG. 11B, the stopper seal 102 is in contact with the stopper seal engagement portion 68 that defines the drinking opening 64 of the main body 12. In this regard, when the stopper 100 is in the closed position shown in FIG. 11B, the stopper seal 102 is pressed against the stopper seal engagement portion 68 of the main body 12 by the biasing member 144 to provide a fluid-tight seal between the container 8 to which the lid 10 is attached and the environment. As shown in FIG. 10, the vent hole seal 117 is configured to be positioned at least partially within the seal seat portion 65 when the stopper assembly 100 is in the closed position as shown in FIG. 11B. In this regard, the vent hole seal 117 is pressed against the seal seat portion 65 by the biasing member 144 at the same time the stopper seal 102 is pressed against the stopper seal engagement portion 68. As can be appreciated, if the vent hole seal 117 and seal seat portion 65 were not configured this way, the stopper assembly 100 may tend to rotate slightly as the stopper seal 102 is pressed against the engagement portion 68, since a force would be applied to the stopper assembly from only one side. This rotation of the stopper assembly 100 could in turn cause the stopper seal 102 to apply uneven pressure to the stopper seal engagement portion 68, which may negatively impact the quality of the seal. In other words, the vent hole seal 117 and the seal seat portion 65 together operate as a balance so that the stopper seal 102 applies an even pressure to the stopper seal engagement portion 68 of the drinking opening 64, thereby providing a fluid-tight seal.

The actuating member 130 is situated such that the first and second cam surfaces 133A and 133B are aligned over the first and second cam follower surfaces 122A and 122B of the cam followers 119A and 119B, respectively, of the stopper 110. The rod 140 of the actuating member 130 is situated within an actuating member opening 25 (also referred to as a "button tunnel") in a rear portion 20 (see FIGS. 10 and 12) of the main body 12 formed by a circumferential wall 26 (or actuating member opening wall). As shown in FIG. 10, the venting wiper seal member 28 is disposed around the base portion 140A of the rod 140 and inward of the circumferential wall 26 inside the button tunnel 25 to provide a fluid-tight seal between the environment and the hollow interior region 36 of the main body 12 when positioned in the button tunnel 25. In turn, the button 30 is coupled to the button coupling portion 140B of the rod 140 of the actuating member 130 (e.g., by a press fit) to allow a user to actuate the actuating member by pressing inward on the button. A button biasing member 32 (e.g., a spring) is positioned over the circumferential wall 26 in a space 34 between the wall 26 and a surrounding outer wall 24 forming a recess in the rear portion 20 of the main body 12. The button biasing member 32 is operative to bias the button 30 and the actuating member 130 coupled thereto to the outward position shown in FIG. 11B which corresponds to the closed position of the stopper 110 and tends to bias the actuating member 130 toward that position.

In operation, a user may depress the button 30 which in turn causes the actuating member 130 to be displaced in an inward, substantially horizontal direction (from the right to the left in the views shown in FIGS. 11B and 11C). As the actuating member 130 is displaced, the first and second cam surfaces 133A and 133B of the actuating member 130 slidably engage the surfaces 122A and 122B of the first and second cam followers 119A and 119B, respectively, of the stopper 110. Since the first and second cam surfaces 133A and 133B each slope downward from the distal end 134 toward the proximal end 132 of the actuating member 130, the surfaces of the first and second cam followers 119A and 119B (and thus the stopper 110) are moved in a downward direction as the actuating member 130 is displaced inward, as shown in FIG. 11C.

As the stopper 110 is moved in a downward direction, a gap 38 (see FIG. 11C) is formed between the stopper seal 102 and the stopper seal engagement portion 68 of the main body 12 such that fluid may pass through the drinking opening 64. Further, in embodiments (not illustrated) wherein a portion of the main body 12 over the seal seat portion 65 defines a vent hole opening, a gap is also formed between the vent hole seal 117 and a vent hole seal engagement portion 69 (see FIG. 10) of the main body 12 allowing air to pass through the opening above the seal seat portion 65 such that fluid may pass through the drinking opening 64 more freely. Additionally, as the actuating member 130 is displaced inward, the wiper seal member 28 exits the button tunnel 25, which provides a passage between the outer environment and the hollow interior portion 36 of the main body 12. The timing of the operation of the sealing members 28, 102, and 117 is discussed below in the section describing the venting mechanism.

It should be appreciated that although in this embodiment the actuating member 130 includes the cam surfaces 133A and 133B and the stopper 110 includes the cam followers 119A and 119B, in other embodiments the actuating member 130 may include one or more cam followers and the stopper 110 may include one or more corresponding cam surfaces.

The lid 10 also comprises a selectively rotatable, exterior dust cover 180 engaged with the upper portion 14 of the main body 12 that is operative to cover the opening 64 when a user is not using the lid (see FIG. 1). The dust cover 180 comprises a downwardly extending button covering portion 182 (or "actuating member covering portion"). The button covering portion 182 extends over the button 30 to prohibit accidental activation of the button 30 (and thus the actuating member 130) when the lid is not in use and the dust cover is rotated into position to cover the opening 64 (see FIG. 5), during which time the stopper 110 would be in the closed position shown in FIG. 11B. The button covering portion 182 also includes a horizontal thin strip or tongue 184 (see FIG. 10) sized to slidably fit within a horizontal corresponding guide groove 15 (see FIGS. 3 and 10) disposed on the perimeter of an outer surface of the upper portion 14 of the main body 12. Thus, a user may selectively rotate the dust cover 180 from a first position wherein the dust cover covers the opening 64 and a portion of the button 30 (see FIGS. 1 and 5), to a second position (see FIGS. 8 and 9) wherein the dust cover does not cover the openings or the button so that the user may operate the lid 10 as described above to drink a fluid housed in the container 8 to which the lid is attached.

Venting Mechanism

As discussed above, when a hot liquid (e.g., coffee, tea, etc.) is stored in the beverage container 8 with the lid 10 secured thereto so that a seal is formed between the interior of the beverage container and the exterior environment, the pressure inside the beverage container may build. Due to this pressure, there is a potential for hot liquid or gas to spray or otherwise be expelled from the drinking opening 64 in the lid 10 when it is opened by a user (e.g., when drinking from the beverage container 8). To prevent this, the vent seal 28, the button tunnel 25, the actuating member 130, and the stopper 110 are configured to together provide a venting mechanism (referenced generally by the numeral 200 in FIG. 13B) that prevents the spray of liquid or gas from the drinking opening 64 of the lid 10 when the lid is opened by a user.

Figure 13A:
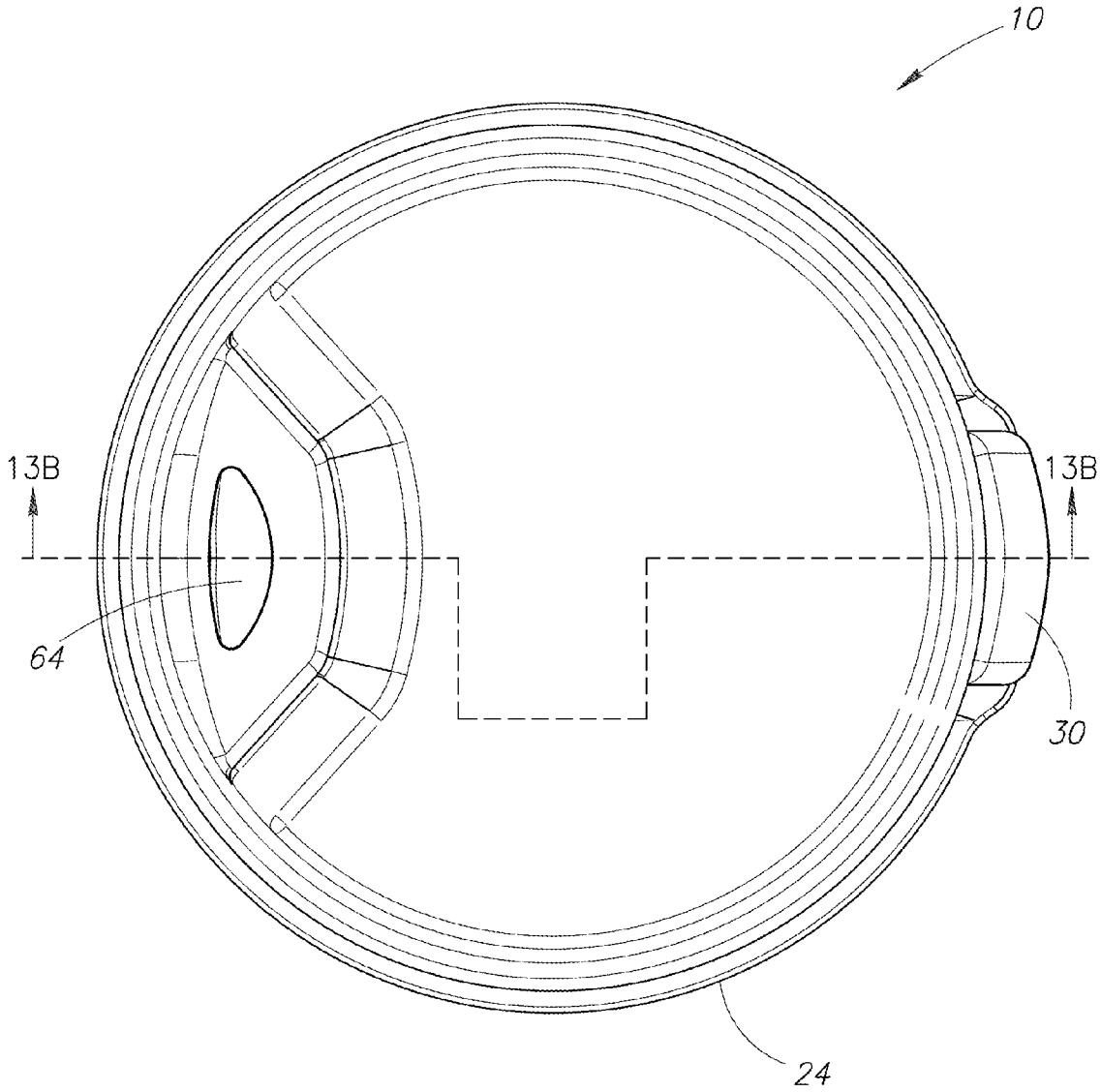
FIG. 13A is an enlarged top plan view of the beverage container closure of FIG. 1 with the dust cover removed.
Figure 13B:
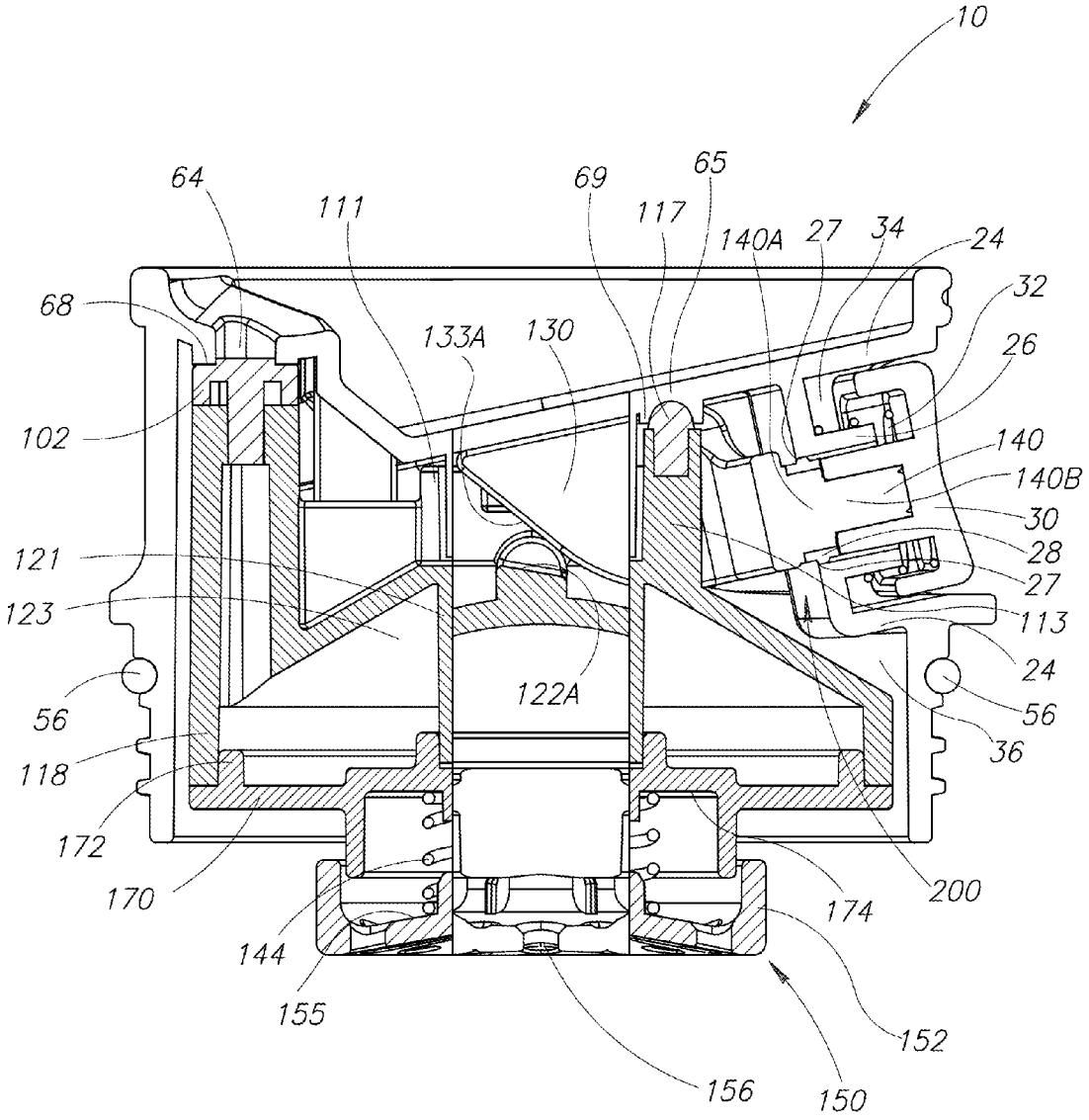
FIG. 13B is a sectional view taken substantially along the line 13B-13B of FIG. 13A with the stopper and a vent seal of the beverage container closure in a sealed position.
Figure 13C:
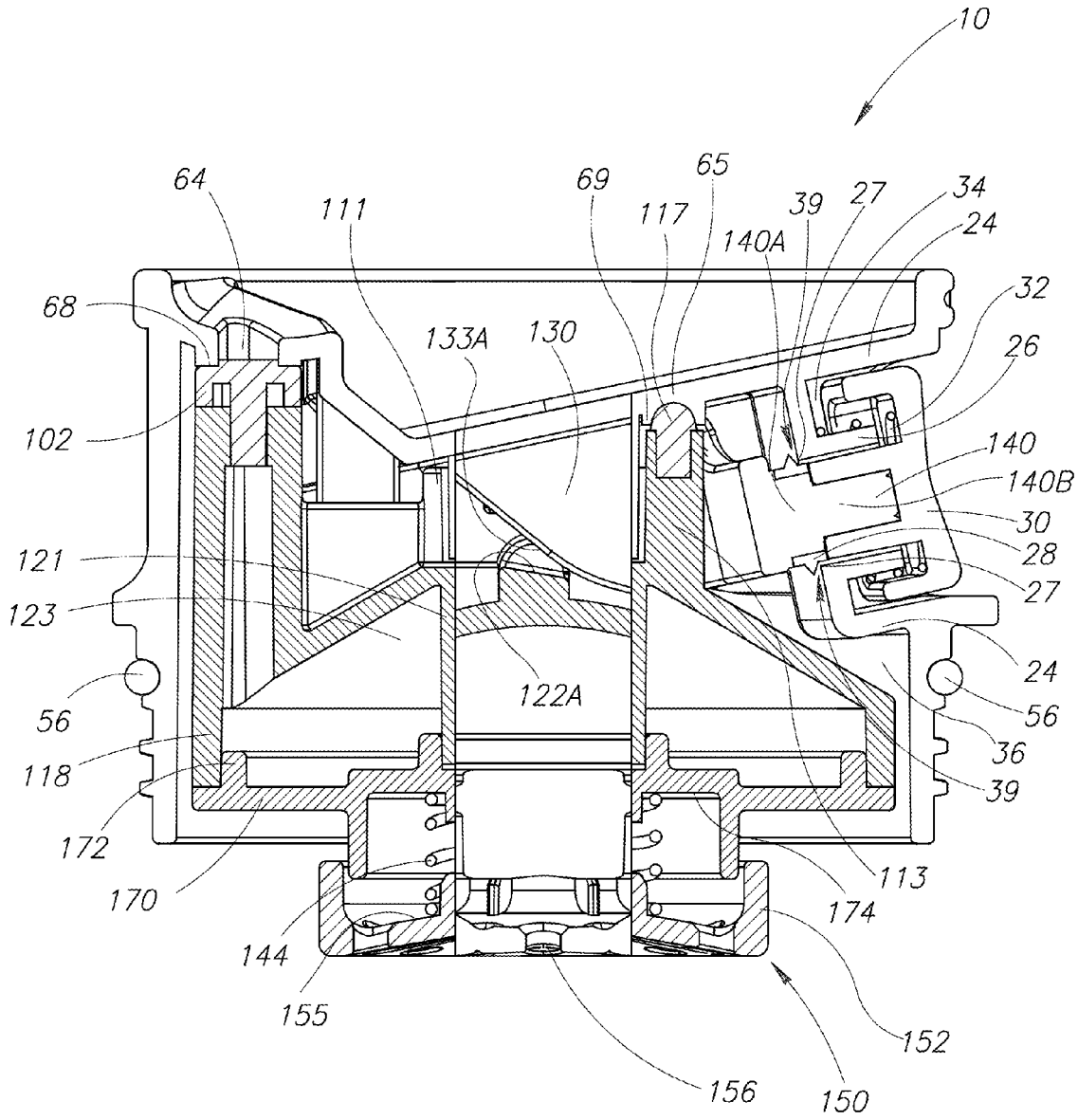
FIG. 13C is a sectional view taken substantially along the line 13B-13B of FIG. 13A with the stopper in a sealed position and the vent seal in an open position.
Figure 13D:
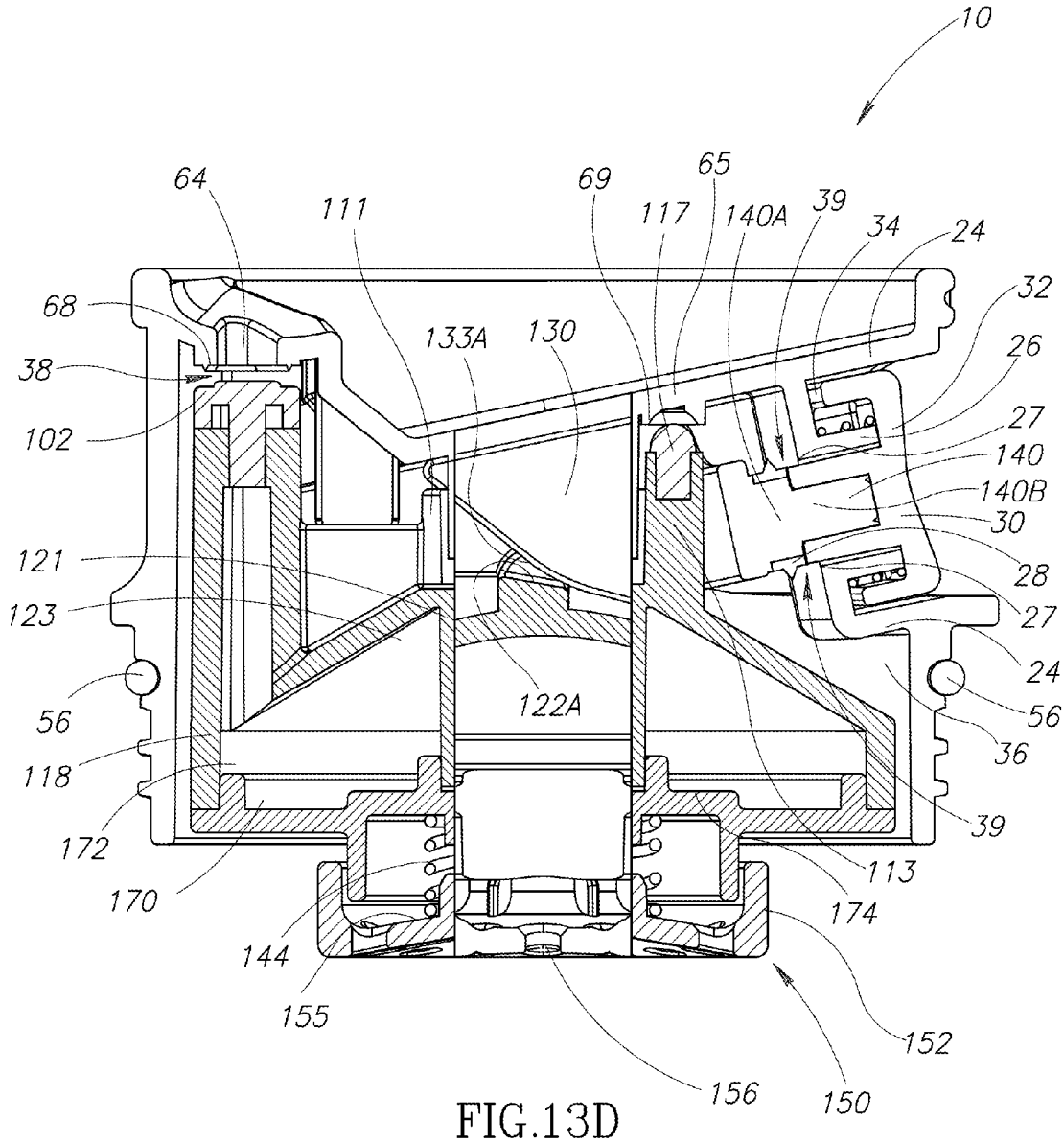
FIG. 13D is a sectional view taken substantially along the line 13B-13B of FIG. 13A with the stopper and the vent seal in an open position.

The operation of the venting mechanism 200 is now described with reference to FIGS. 13B, 13C, and 13D, which show sectional views of the lid 10 taken substantially along the line 13B-13B of FIG. 13A, when the button 30 is not depressed by a user (FIG. 13B), when the button is partially depressed (FIG. 13C), and when the button is fully depressed (FIG. 13D). In FIG. 13B, the vent seal 28 and the stopper 110 are both in a sealed position. In FIG. 13C, the vent seal 28 is in a venting or open position, and the stopper 110 remains in the sealed position. In FIG. 13D, the vent seal 28 and the stopper 110 are both in the open position.

As shown in FIG. 13B, when the button 30 is not being depressed by a user, the stopper seal 102 is in contact with the stopper seal engagement portion 68 that defines the drinking opening 64 of the main body 12. In this regard, when the stopper 100 is in the closed position shown in FIG. 13B, the stopper seal 102 is pressed against the stopper seal engagement portion 68 of the main body 12 by the biasing member 144 to provide a fluid-tight seal between the container 8 to which the lid 10 is attached and the environment. Further, the vent seal 28 is disposed around the base portion 140A of the rod 140 and outward of an inner-most edge 27 of the circumferential wall 26, such that it is positioned inside the button tunnel 25 to provide a fluid-tight seal between the environment and the hollow interior region 36 of the main body 12.

FIG. 13C depicts the lid 10 when the button 30 is partially depressed by a user. As can be appreciated, the button 30 may be moved into this partially depressed position of FIG. 13C as a user moves the button between the non-depressed position shown in FIG. 13B and the fully depressed position shown in FIG. 13D. In this partially depressed position, the vent seal 28 has been displaced inward by a sufficient amount so that it is positioned inward of the edge 27 of the circumferential wall 26, outside the button tunnel 25, such that an air gap 39 is formed that allows for the passage of air between the outer environment and the hollow interior portion 36 of the main body 12.

Importantly, the actuating member 130 is configured such that the first and second cam surfaces 133A and 133B are aligned over the surfaces, e.g., the surface 122A of the cam follower 119A and the surface 122B of the cam follower 119B of the first and second cam follower 119A and 119B, respectively, in a manner such that the first and second cam surfaces do not engage the first and second cam follower surfaces, respectively, to move the stopper 110 in a downward direction until the button 30 has been depressed inward sufficiently for the vent seal 28 to exit the button tunnel 25 and for the air gap 39 to be formed. Thus, during operation when a user depresses the button 30, the vent seal 28 is opened before the drinking opening 64 is opened. Accordingly, any pressure that has built up within the beverage container 8 will be released through the air gap 39 when the user depresses the button 30. This configuration prevents the possibility of air or liquid being expelled or sprayed out of the drinking opening 64, since the drinking opening is only opened after the air gap 39 has formed and the pressure within the container has equalized.

FIG. 13D illustrates the condition when a user has fully depressed the button 30, which causes the actuating member 130 to be displaced even further than shown in FIG. 13C in an inward, substantially horizontal direction. As the actuating member 130 is displaced, the first and second cam surfaces 133A and 133B of the actuating member 130 slidably engage the surfaces 122A and 122B of the first and second cam followers 119A and 119B, respectively, as described above. As the stopper 110 is moved in a downward direction, the gap 38 is formed between the stopper seal 102 and the stopper seal engagement portion 68 of the main body 12 such that fluid may pass through the drinking opening 64. As shown, the air gap 39 is also present when the button 30 is in the fully depressed position shown in FIG. 13D. In additional to providing venting capability immediately when the lid 10 is first opened by a user, the air gap 39 also allows fluid to pass through the drinking opening 64 more freely as a user drinks from the beverage container 8.

As can be appreciated, the assembly described above may be disassembled by a user for cleaning if desired. As may best be viewed in FIGS. 10 and 12, a user may simply unscrew the stopper cover 150 from the stopper cover engagement portion 22 of the main body 12, which will release the stopper 110 and the stopper cap 170, the stopper cover 150, and the stopper biasing member 144 from the hollow interior region 36 of the main body. Once these components have been cleaned, the user may then reassemble the lid 10 by first inserting the stopper 110 back into the hollow interior region 36 of the main body 12. Then, the user may position the stopper biasing member 144 over the rod 161 of the stopper cover 150, and threadably connect the engagement portion 162 of the stopper cover with the stopper cover engagement portion 22 of the main body 12, thereby securing the stopper 110 within the hollow interior portion 36 of the main body.

Further, since both the actuating member 130 and the stopper 110 are biased by the button biasing member 32 and the stopper biasing member 144, respectively, the stopper 110 automatically returns to the sealed or closed position (shown in FIG. 11B) once the user removes pressure from the button 30. In this regard, the user may open and drink from the container 8 shown in FIG. 1 to which the lid 10 is attached using one hand by simply pressing the button 30 inward with a finger of the hand holding the container while consuming a beverage and releasing the button thereafter to automatically reseal the container. As can be appreciated, the ability to open, drink from, and close a container using only one hand may be desirable for various active users including bicyclists, hikers, drivers, and the like.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A lid for use with a drinking vessel containing a liquid, comprising:

a main body selectively couplable to the drinking vessel, the main body including an upper portion having a drinking opening configured to permit fluid passage therethrough when the lid is coupled to the drinking vessel, the upper portion further including a first engagement portion facing downward toward an interior portion of the main body, the main body further including a sidewall having an actuating member opening formed by an actuating member opening wall that extends through the sidewall into the interior portion of the main body;

a stopper disposed substantially within the interior portion of the main body and configured for upward displacement into a closed position wherein the stopper engages a portion of the main body and covers the drinking opening to prevent fluid passage therethrough, and downward displacement into an opened position wherein the stopper is spaced apart from the portion of the main body to allow fluid passage through the drinking opening, the stopper having an interior wall forming a stopper opening extending vertically through the stopper, the stopper having a first cam follower and a second cam follower spaced apart from each other on opposite sides of the interior wall;

a stopper retainer comprising a base portion and rod portion extending upwardly therefrom sized to pass through the stopper opening, the rod portion terminating with a second engagement portion configured to selectively engage the first engagement portion of the main body, the base portion having a size that is larger than the stopper opening such that the base portion restricts the downward displacement of the stopper and the stopper is maintained substantially within the interior portion of the main body;

an actuating member extending through the actuating member opening, the actuating member being movably coupled to the main body, the actuating member being movable inward and outward, and having a first cam surface and a second cam surface spaced apart from each other such that when the actuating member is moved inward the first and second cam surfaces are positioned on opposite sides of the rod portion of the stopper retainer, the first and second cam surfaces being positioned to slidably engage the first and second cam followers, respectively, of the stopper during inward movement of the actuating member to cause the first and second cam surfaces to simultaneously move the first and second cam followers downward which moves the stopper to the opened position, and being positioned such that during outward movement of the actuating member the first and second cam surfaces permit the first and second cam followers, respectively, to move upward which permits movement of the stopper to the closed position; and a seal member coupled to the actuating member and positioned within the actuating member opening between the actuating member and the actuating member opening wall when the actuating member is disposed in an outward position to provide a fluid-tight seal that prevents fluid passage through the actuating member opening, and as the actuating member is moved inward the seal member moves inward to a position at least partially out of the actuating member opening to break the fluid-tight seal prior to the first cam surface moving the first cam follower downward which moves the stopper to the opened position.

2. The lid of claim 1, wherein the actuating member comprises a base portion and a button coupling portion extending outward from the base portion, the seal member being coupled to the base portion, the lid further comprising:

a button coupled to the button coupling portion of the actuating member and disposed outward of the actuating member opening such that pressing on the button moves the actuating member inward.

3. The lid of claim 1, wherein the actuating member is biased toward the outward position and the stopper is biased toward the closed position.

4. The lid of claim 1, wherein the seal member is configured to be outside the actuating member opening when the stopper is in the opened position.

5. The lid of claim 1, further comprising:

a stopper biasing member coupled to the stopper and configured to bias the stopper into the closed position in response to outward movement of the actuating member.

6. The lid of claim 1, further comprising:

a button coupled to the actuating member such that pressing on the button moves the actuating member inward.

7. The lid of claim 1, further comprising:

a stopper biasing member coupled to the stopper and configured to bias the stopper upward into the closed position upon outward movement of the actuating member; and an actuating member biasing member operatively coupled to the actuating member and configured to bias the actuating member to move outward to allow the seal member to move into the actuating member opening, and to allow the stopper biasing member to move the stopper upward into the closed position.

8. The lid of claim 7, wherein at least one of the stopper biasing member and the actuating member biasing member comprises a spring.

9. A lid for use with a drinking vessel containing a liquid, comprising:

a main body selectively couplable to the drinking vessel, the main body including an upper portion having a drinking opening configured to permit fluid passage therethrough when the lid is coupled to the drinking vessel, the upper portion further including a main body wall extending downward from the upper portion into an interior portion and having an outer perimeter, the main body further including a sidewall having an actuating member opening formed by an actuating member opening wall that extends through the sidewall;

a stopper movably coupled to the main body and disposed substantially within the interior portion thereof, the stopper configured for upward displacement into a closed position wherein the stopper engages a portion of the main body and covers the drinking opening to prevent fluid passage therethrough, and downward displacement into an opened position wherein the stopper is spaced apart from the portion of the main body to allow fluid passage through the drinking opening, the stopper having a stopper wall extending upward therefrom having an inner perimeter that is slightly larger than the outer perimeter of the main body wall such that the stopper wall and the main body wall are permitted to move axially with respect to each other in a telescoping relationship and the main body wall restricts lateral movement of the stopper wall to maintain vertical alignment of the stopper with respect to the main body, the stopper further having first and second cam followers spaced apart from each other on opposite sides of the stopper wall;

an actuating member extending through the actuating member opening, the actuating member being movably coupled to the main body, the actuating member being movable inward and outward, and having first and second cam surfaces spaced apart from each other, the first and second cam followers of the stopper being positioned to be slidably engaged by the first and second cam surfaces of the actuating member, respectively, during inward movement of the actuating member to move the first and second cam followers downward which moves the stopper to the opened position, and being positioned such that during outward movement of the actuating member the first and second cam surfaces permit the first and second cam followers to move upward which permits movement of the stopper to the closed position; and a seal member coupled to the actuating member and positioned within the actuating member opening between the actuating member and the actuating member opening wall when the actuating member is disposed in an outward position to provide a fluid-tight seal that prevents fluid passage through the actuating member opening, and as the actuating member is moved inward the seal member moves inward to a position at least partially out of the actuating member opening to break the fluid-tight seal prior to the first and second cam surfaces moving the first and second cam followers downward which moves the stopper to the opened position.

10. The lid of claim 9, further comprising a stopper biasing spring coupled to the stopper and positioned to bias the stopper into the closed position upon outward movement of the actuating member.

11. A drinking vessel and lid assembly, comprising:

a drinking vessel; and a lid comprising:

a main body selectively couplable to the drinking vessel, the main body including an upper portion having a drinking opening configured to permit fluid passage therethrough when the lid is coupled to the drinking vessel, the main body further including a sidewall having an actuating member opening formed by an actuating member opening wall that extends through the sidewall;

a stopper movably coupled to the main body and configured for upward displacement into a closed position wherein the stopper engages a portion of the main body and covers the drinking opening to prevent fluid passage therethrough, and downward displacement into an opened position wherein the stopper is spaced apart from the portion of the main body to allow fluid passage through the drinking opening, the stopper having a first cam follower and a second cam follower spaced apart from each other;

an actuating member extending through the actuating member opening, the actuating member being movably coupled to the main body, the actuating member being movable inward and outward, and having a first cam surface and a second cam surface spaced apart from each other, the first and second cam surfaces being positioned to slidably engage the first and second cam followers, respectively, of the stopper during inward movement of the actuating member to cause the first and second cam surfaces to move the first and second cam followers, respectively, downward which moves the stopper to the opened position, and being positioned such that during outward movement of the actuating member the first and second cam surfaces permits the first and second cam followers, respectively, to move upward which permits movement of the stopper to the closed position;

a seal member coupled to the actuating member and positioned within the actuating member opening between the actuating member and the actuating member opening wall when the actuating member is disposed in an outward position to provide a fluid-tight seal that prevents fluid passage through the actuating member opening, and as the actuating member is moved inward the seal member moves inward to a position whereat the fluid-tight seal between the seal member and the actuating member opening wall is broken prior to the first cam surface moving the first cam follower downward sufficiently to move the stopper to the opened position; and a dust cover movably coupled to the upper portion of the main body and selectively rotatable between a first position wherein the dust cover is disposed over the drinking opening of the main body, and a second position wherein the dust cover is disposed over the main body at a position away from the drinking opening, the dust cover comprising a tongue configured to fit within a corresponding perimeter groove disposed on an outer surface of the upper portion of the main body, and an actuating member covering portion configured to block access to the actuating member and prohibit accidental activation of the actuating member when the dust cover is in the first position.

12. The drinking vessel and lid assembly of claim 11, wherein the lid further comprises:

a stopper biasing member coupled to the stopper and arranged to bias the stopper toward the closed position as the actuating member moves outward; and an actuating member biasing member arranged to bias the actuating member outward.

13. The drinking vessel and lid assembly of claim 12, wherein at least one of the stopper biasing member and the actuating member biasing member comprises a spring.

14. The drinking vessel and lid assembly of claim 11, wherein the actuating member comprises a base portion and a button coupling portion extending outward from the base portion, the seal member being coupled to the base portion, and the lid further comprises a button coupled to the button coupling portion of the actuating member and disposed outward of the actuating member opening such that pressing on the button moves the actuating member inward.

15. A lid for use with a drinking vessel containing a liquid, comprising:

a main body selectively couplable to the drinking vessel, the main body including an upper portion having a drinking opening configured to permit fluid passage therethrough when the lid is coupled to the drinking vessel, the main body further including a sidewall having an actuating member opening formed by an actuating member opening wall that extends through the sidewall;

a stopper movably coupled to the main body and configured for upward displacement into a closed position wherein the stopper engages a portion of the main body and covers the drinking opening to prevent fluid passage therethrough, and downward displacement into an opened position wherein the stopper is spaced apart from the portion of the main body to allow fluid passage through the drinking opening, the stopper having a stopper aperture therein extending fully through a vertical axis of the stopper, the stopper further having a stopper engagement portion comprising one of:

first and second cam surfaces spaced apart from each other on opposite sides of the stopper aperture; and first and second cam followers spaced apart from each other on opposite sides of the stopper aperture;

an actuating member extending through the actuating member opening, the actuating member being movably coupled to the main body, the actuating member being movable inward and outward, and having an actuating member engagement portion comprising the other of: the first and second cam surfaces; and the first and second cam followers, the actuating member engagement portion of the actuating member being positioned to slidably engage the stopper engagement portion of the stopper during inward movement of the actuating member to cause the actuating member engagement portion to move the stopper engagement portion downward which moves the stopper to the opened position, and being positioned such that during outward movement of the actuating member the actuating member engagement portion permits the stopper engagement portion to move upward which permits movement of the stopper to the closed position; and a seal member coupled to the actuating member and positioned within the actuating member opening between the actuating member and the actuating member opening wall when the actuating member is disposed in an outward position to provide a fluid-tight seal that prevents fluid passage through the actuating member opening, and as the actuating member is moved inward, the seal member moves inward to a position whereat the fluid-tight seal between the seal member and the actuating member opening wall is broken prior to the actuating member engagement portion moving the stopper engagement portion downward sufficiently to move the stopper to the opened position; and a stopper retainer comprising a base portion and rod portion extending upwardly therefrom sized to pass through the stopper aperture and to selectively engage a portion of the main body, the base portion having a size that is larger than the stopper aperture such that when the rod portion is selectively engaged with the portion of the main body the base portion restricts the downward displacement of the stopper.

16. A lid for use with a drinking vessel containing a liquid, comprising:

a main body selectively couplable to the drinking vessel, the main body including a drinking opening configured to permit fluid passage therethrough when the lid is coupled to the drinking vessel, the main body further including an actuating member opening that extends through a wall of the main body;

a stopper movably coupled to the main body and configured for displacement into a closed position wherein the stopper engages a portion of the main body and covers the drinking opening to prevent fluid passage therethrough, and displacement into an opened position wherein the stopper is spaced apart from the portion of the main body to allow fluid passage through the drinking opening;

an actuating member extending through the actuating member opening, the actuating member being movably coupled to the main body and engageable with the stopper to cause the stopper to be moved to the opened position when a user moves the actuating member by applying a force thereto, and being positioned such that when the user removes the force from the actuating member, the actuating member permits the stopper to move to the closed position;

a seal member positioned within the actuating member opening such that when the user is not applying a force to the actuating member the seal member provides a fluid-tight seal that prevents fluid passage through the actuating member opening, and when the user moves the actuating member, the seal member also moves to a position whereat the fluid-tight seal is broken prior to the stopper being moved to the opened position; and a dust cover movably coupled to the upper portion of the main body and selectively rotatable between a first position wherein the dust cover is disposed over the drinking opening of the main body, and a second position wherein the dust cover is disposed over the main body at a position away from the drinking opening, the dust cover comprising a tongue configured to fit within a corresponding perimeter groove disposed on an outer surface of the upper portion of the main body, and an actuating member covering portion configured to block access to the actuating member and prohibit accidental activation of the actuating member when the dust cover is in the first position.

17. The lid of claim 16, wherein the actuating member comprises a base portion and a button coupling portion extending outward from the base portion, the seal member being coupled to the base portion, the lid further comprising:

a button coupled to the button coupling portion of the actuating member and disposed outward of the actuating member opening such that pressing on the button moves the actuating member inward.

18. The lid of claim 16, further comprising a stopper biasing member coupled to the stopper and arranged to bias the stopper toward the closed position.

19. The lid of claim 16, wherein the seal member is configured to be outside the actuating member opening when the stopper is in the opened position.

* * * * *